US009895041B2

(12) United States Patent
Balas et al.

(10) Patent No.: US 9,895,041 B2
(45) Date of Patent: Feb. 20, 2018

(54) CLEANING DEVICE WITH SINGLE TANK RECYCLING SYSTEM

(71) Applicant: Diversey, Inc., Portland, OR (US)

(72) Inventors: Stephen J. Balas, Midlothian, VA (US); Stephen D. Herr, Richmond, VA (US); Henry L. Hillman, Jr., Vancouver, WA (US); Victor Chi-Chih Huang, Henrico, VA (US); Ralph McCann, Williamsburg, VA (US); Kevin L. Thomas, Richmond, VA (US)

(73) Assignee: Diversey, Inc., Charlotte, NC (US)

( * ) Notice: Subject to any disclaimer, the term of this patent is extended or adjusted under 35 U.S.C. 154(b) by 444 days.

(21) Appl. No.: 14/707,415

(22) Filed: May 8, 2015

(65) Prior Publication Data

US 2015/0238060 A1 Aug. 27, 2015

Related U.S. Application Data

(63) Continuation of application No. 13/085,166, filed on Apr. 12, 2011, now Pat. No. 9,028,617.

(51) Int. Cl.

| | |
|---|---|
| ***B08B 3/04*** | (2006.01) |
| ***A47L 11/40*** | (2006.01) |
| ***B08B 3/00*** | (2006.01) |
| ***B08B 3/02*** | (2006.01) |
| ***B08B 3/14*** | (2006.01) |

(52) U.S. Cl.

CPC ..... *A47L 11/4022* (2013.01); *A47L 11/4011* (2013.01); *A47L 11/4088* (2013.01); *B08B 3/00* (2013.01); *B08B 3/024* (2013.01); *B08B 3/14* (2013.01); *B08B 2203/0229* (2013.01)

(58) Field of Classification Search

None

See application file for complete search history.

(56) References Cited

U.S. PATENT DOCUMENTS

| | | | |
|---|---|---|---|
| 3,753,777 | A | 8/1973 | Thomsen et al. |
| 4,778,532 | A | 10/1988 | McConnell et al. |
| 4,809,909 | A | 3/1989 | Kukesh |
| 5,190,065 | A | 3/1993 | Kovac et al. |
| 5,331,713 | A | 7/1994 | Tipton |
| 5,593,598 | A | 1/1997 | McGinness et al. |
| 5,704,989 | A | 1/1998 | Page |
| 6,857,162 | B1 | 2/2005 | Rasmussen |
| 7,272,869 | B1 | 9/2007 | Robinson |
| 2007/0186369 | A1 | 8/2007 | Field et al. |

FOREIGN PATENT DOCUMENTS

| | | | |
|---|---|---|---|
| EP | 1352692 | A1 | 10/2003 |
| GB | 2465675 | A | 6/2010 |

*Primary Examiner* — Michael Kornakov
*Assistant Examiner* — Ryan Coleman
(74) *Attorney, Agent, or Firm* — Fox Rothschild LLP

(57) ABSTRACT

A cleaning device may include a solution tank configured to store cleaning solution. The device delivers the cleaning solution from a pump discharge of the cleaning device to a flow meter. The device initiates a priming mode by opening a first valve associated with a bypass line of the device, closing a second valve associated with a cleaning head of the cleaning device, and delivering the cleaning solution from a discharge of the flow meter to the inlet of the solution tank through the bypass line. When the device is primed, it initiates cleaning by closing the first valve associated with the bypass line, opening the second valve associated with the cleaning head, and delivering the cleaning solution to the cleaning head.

18 Claims, 7 Drawing Sheets

CLEANING DEVICE WITH SINGLE TANK RECYCLING SYSTEM

RELATED APPLICATIONS AND CLAIM OF PRIORITY

This patent document claims priority to, and is a continuation of, U.S. patent application Ser. No. 13/085,166, filed Apr. 12, 2011. The disclosure of the priority application is fully incorporated herein by reference.

BACKGROUND

Cleaning devices that use solution to clean floors or other surfaces typically do not reuse and recycle cleaning solution. Usually, cleaning solution that is applied to a surface is returned, along with any soil or other debris, to a recovery tank of the cleaning device that is used to store dirty cleaning solution. When all of the clean cleaning solution has been used, the cleaning device must generally be taken to a maintenance area so that the dirty solution can be drained and the cleaning device can be refilled with new cleaning solution.

Some cleaning devices utilize a recycling system to filter soils from the cleaning solution to extend the runtime of the cleaning device between empty and refill cycles. Often, recycling systems of cleaning devices include two tanks, a cleaning solution tank and a dirty solution recovery tank. The recovered dirty solution is usually cleaned and deposited into the dirty solution recovery tank. From there, it is often filtered or otherwise sanitized, and then added to the clean solution tank for further use.

SUMMARY

This disclosure is not limited to the particular systems, methodologies or protocols described, as these may vary. The terminology used in this description is for the purpose of describing the particular versions or embodiments only, and is not intended to limit the scope.

As used in this document, the singular forms "a," "an," and "the" include plural reference unless the context clearly dictates otherwise. Unless defined otherwise, all technical and scientific terms used herein have the same meanings as commonly understood by one of ordinary skill in the art. All publications mentioned in this document are incorporated by reference. All sizes recited in this document are by way of example only, and the invention is not limited to structures having the specific sizes or dimensions recited below. Nothing in this document is to be construed as an admission that the embodiments described in this document are not entitled to antedate such disclosure by virtue of prior invention. As used herein, the term "comprising" means "including, but not limited to."

In an embodiment, a cleaning device may include a solution tank configured to store cleaning solution. The solution tank may include an inlet and an outlet. The cleaning device may include at least one discharge line filter in fluid communication with the solution tank and a pump having a pump intake and a pump discharge. The pump may be configured to direct cleaning solution from the solution tank outlet through the at least one discharge line filter. The cleaning device may include a cleaning head in fluid communication with the pump discharge and a bypass line in fluid communication with the pump discharge and the inlet. The bypass line may be configured to divert cleaning solution received from the pump discharge away from the cleaning head and toward the solution tank.

In an embodiment, a method of cleaning a surface may include drawing cleaning solution through a tank filter in fluid communication with an outlet of a solution tank, drawing the cleaning solution through one or more discharge line filters to a pump intake and delivering the cleaning solution from a pump discharge to a flow meter. The method may include, in response to a cleaning device not being primed, initiating priming mode by opening a first valve associated with the bypass line, closing a second valve associated with the cleaning head, and delivering the cleaning solution from a discharge of the flow meter to an inlet of the solution tank through a bypass line. The method may include, in response to the cleaning device being primed, initiating cleaning by closing a first valve associated with the bypass line, opening a second valve associated with a cleaning head, and delivering the cleaning solution to the cleaning head.

DETAILED DESCRIPTION

Figure 1:
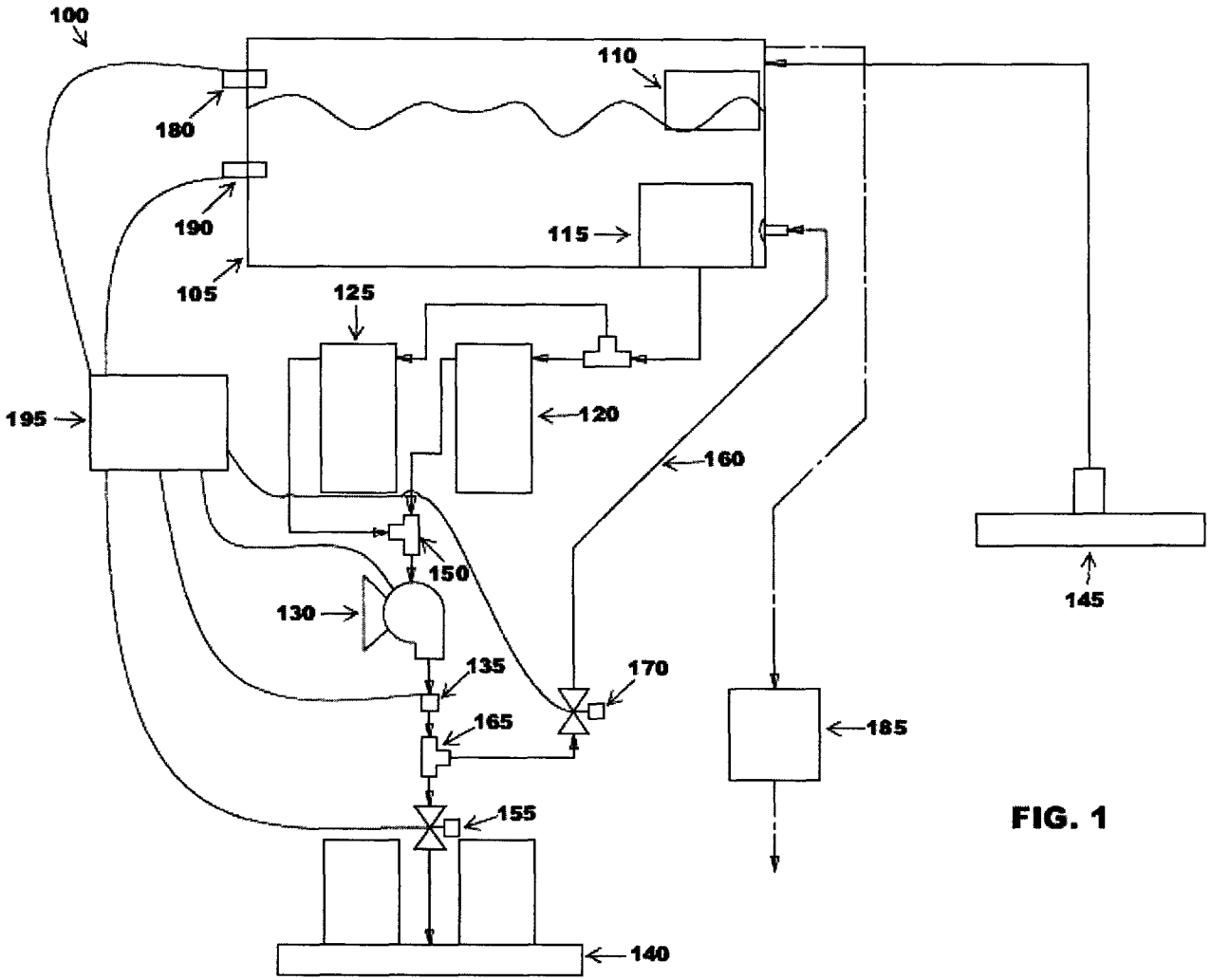
FIG. 1 illustrates an exemplary cleaning device according to an embodiment.

FIG. 1 illustrates an exemplary cleaning device according to an embodiment. In an embodiment, a cleaning device may be an autonomous mobile device that can automatically navigate and clean surfaces, such as floors. In an embodiment, a cleaning device may be a robotic device. In an embodiment, a cleaning device may be configured to clean large surfaces. As illustrated by FIG. 1, a cleaning device 100 may include one or more of a solution tank 105, a pre-filter 110, a tank filter 115, a first discharge line filter 120, a second discharge line filter 125, a pump 130, a flow meter 135, a cleaning head 140, a squeegee 145 and a motor 185.

In an embodiment, a solution tank 105 may be a single tank, and it may store cleaning solution. Cleaning solution may be a liquid used to clean one or more surfaces, such as water, a chemical solution, a combination of water and one or more chemical solutions and/or the like. A solution tank 105 may have one or more inlets through which cleaning solution enters the solution tank. In an embodiment, a solution tank 105 may have one or more outlets through which cleaning solution exits the solution tank. In an embodiment, a solution tank 105 may include one or more float switches to detect a level of cleaning solution present in the solution tank. For example, a solution tank 105 may include an upper float switch 180 and a lower float switch 190. In an embodiment, a tank filter 115 may be located within a solution tank 105 in proximity to and/or in fluid communication with an outlet of the solution tank. In an embodiment the tank filter 115 may be a sump filter formed from 100 mesh (or another size) stainless steel wire. The tank filter 115 may filter solution as it is drawn from within the solution tank 105 to an outlet of the solution tank. For example, the tank filter 115 may filter dirt or other debris from the solution as it exits the solution tank 105.

The first discharge line filter 120 and the second discharge line filter 125 may each be any suitable filter, such as a cartridge filter. In an embodiment, the first discharge line filter 120 and/or the second discharge line filter 125 may be located outside of the solution tank 105 so that they filter fluid that has been discharged from an outlet of the solution tank. In an embodiment, a solution tank 105 may be in fluid communication with the first discharge line filter 120 and/or the second discharge line filter 125. For example, a solution tank 105 may be connected to a first discharge line filter 120 and/or the second discharge line filter 125 by one or more fluid lines and/or a tee fitting. In an embodiment, the first discharge line filter 120 and the second discharge line filter 125 may be fluidly connected in parallel, as illustrated by FIG. 1. In another embodiment, a first discharge line filter 120 and a second discharge line filter 125 may be fluidly connected in series.

In an embodiment, the first discharge line filter 120 and/or the second discharge line filter 125 may be a pleated filter, a wound cotton filter and/or the like. In an embodiment, the first discharge line filter 120 and/or the second discharge line filter 125 may be approximately ten inches long. The first discharge line filter 120 and/or the second discharge line filter 125 may be formed from pleated cellulose, polyester and/or polypropylene and may have one or more plastic ends and a core.

In an embodiment, the first discharge line filter 120 and/or the second discharge line filter 125 may filter dirt or other debris from received cleaning solution that is discharged from the solution tank 105. In an embodiment, typically when the first discharge line filter 120 and the second discharge line filter 125 are connected in parallel, the first discharge line filter and the second discharge line filter may each be of substantially the same filter size. Alternatively, such as when the first discharge line filter 120 and the second discharge line filter 125 are connected in series, the filters may have different filter sizes. In an embodiment, filter size of a filter may refer to the size of the largest particles that can be filtered by the filter. For example, a filter having a filter size of 1 micron can filter particles having a size of 1 micron or larger. In an embodiment, the first discharge line filter 120 may be a 10 micron filter so that it filters large particles in the cleaning solution. The second discharge line filter 125 may be a 1 micron filter so that it filters fine particles that remain in the cleaning solution. In an embodiment, the first discharge line filter 120 and the second discharge line filter 125 may have equal filter sizes. For example, the first discharge line filter and the second discharge line filter may both be 10 micron filters. Additional and/or alternate sized filters may be used within the scope of this disclosure.

In an embodiment, a first discharge line filter 120 and/or a second discharge line filter 125 may include an inlet and an outlet. Cleaning solution may be drawn from an outlet of a solution tank 105 to an inlet of a first discharge line filter 120 and/or a second discharge line filter 125. Cleaning solution may be drawn through a first discharge line filter 120 and/or a second discharge line filter 125 through an inlet of the respective filter and out of the first discharge line filter and/or a second discharge line through an outlet of the respective filter.

Figure 5:
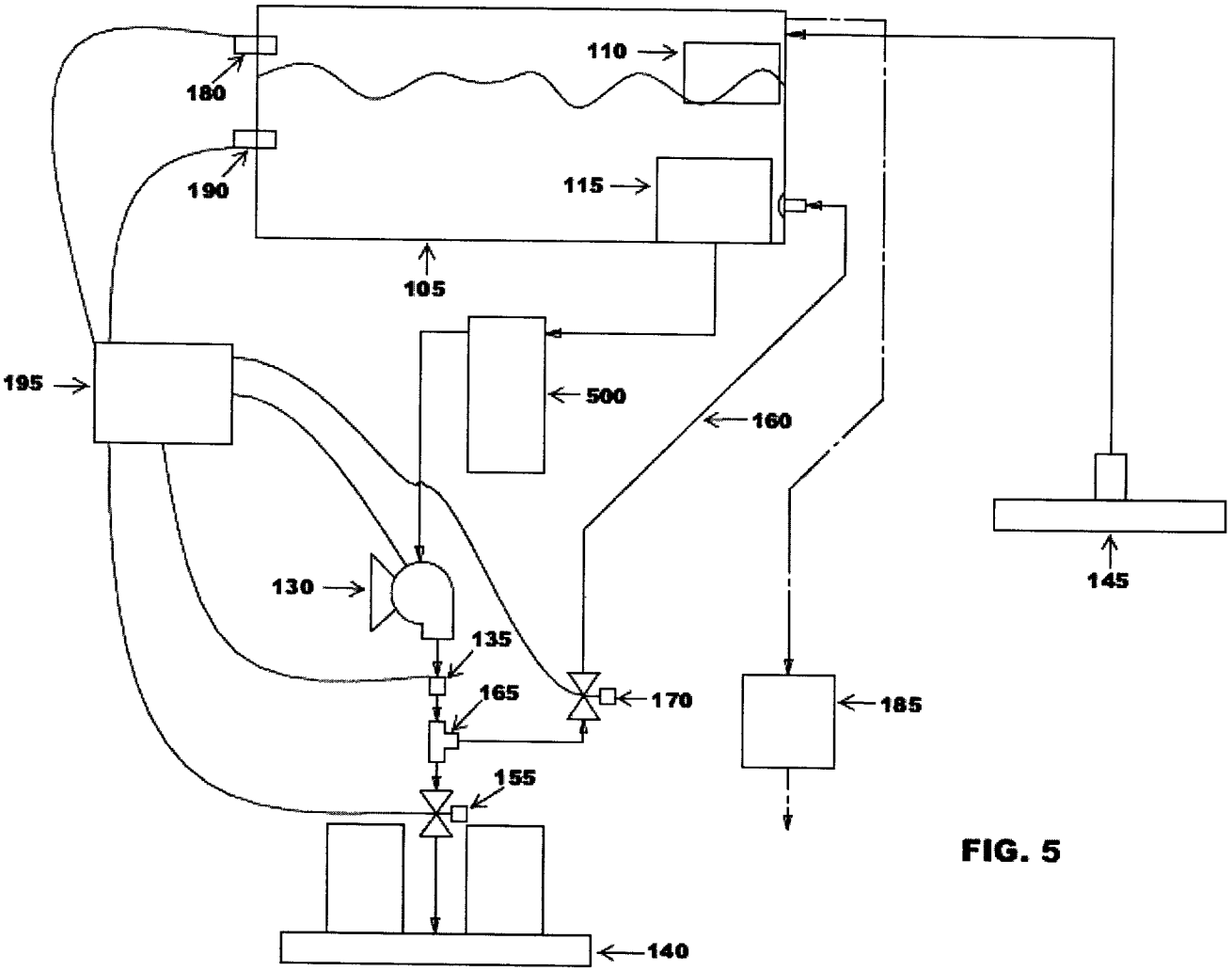
FIG. 5 illustrates an exemplary cleaning device according to an embodiment.

In an embodiment, a cleaning device may have a single discharge line filter as illustrated by FIG. 5. An inlet of the discharge line filter 500 may be fluidly connected to an outlet of a solution tank 105, and an outlet of the discharge line filter may be fluidly connected to a pump intake. Cleaning fluid may be drawn from the solution tank 105 through the discharge line filter 500 to the pump 130.

In an embodiment, cleaning solution may flow from an outlet of the first discharge line filter 120 or a second discharge line filter 125 to a pump 130. In an embodiment, cleaning solution may flow from an outlet of the first discharge line filter 120 or a second discharge line filter 125 to a pump 130 via a tee fitting 150. In an embodiment, a pump 130 may have a pump intake through which the pump may draw cleaning solution. In an embodiment, a pump 130 may have a pump outtake through which the pump may deliver cleaning solution.

In an embodiment, cleaning solution may be delivered from the pump 130 through a flow meter 135. In an embodiment, the flow meter 135 may communicate the flow rate of the cleaning solution to a pump controller 195. In an embodiment, a pump controller 195 may be implemented in hardware, software or a combination of hardware and software. For example, a pump controller 195 may be a computing device, such as a CPU or other type of processor. In an embodiment, a pump controller 195 may be located within the cleaning device. In an alternate embodiment, a pump controller may be located remotely from the cleaning device, and may communicate with the cleaning device wirelessly.

In an embodiment, a pump controller 195 may be in communication with the pump 130, the upper float switch 180, the lower float switch 190, the flow meter 135, the first valve 155 and/or the second valve 170. In an embodiment, the pump controller may adjust the pump voltage based on the flow rate that is received from the flow meter 135. In an embodiment, the pump controller 195 may use pulse-width modulation to adjust the pump voltage to maintain constant flow. For example, if the flow rate exceeds a threshold value, the pump controller 195 may reduce the pump voltage. In an embodiment, if the flow rate does not exceed a threshold value, the pump controller 195 may increase the pump voltage.

In an embodiment, a first valve 155 may control flow of cleaning solution to the cleaning head 140. In an embodiment, a first valve may be a solenoid valve or other type of valve. In an embodiment, a cleaning head may include one or more scrubbers, brushes, nozzles, vacuums and/or the like. In an embodiment, the first valve 155 may be located between the pump 130 and the cleaning head 140. In an embodiment, cleaning solution may be delivered from the first valve 155 to the cleaning head 140 where it may be used by the cleaning device 100 to clean a surface. In an embodiment, the used cleaning solution may be vacuumed or otherwise suctioned into the cleaning device through a squeegee 145, a sponge or other absorbent instrument. The used cleaning solution may pass through the pre-filter 110 before being added to the cleaning solution in the solution tank 105. In an embodiment, the pre-filter 110 may filter cleaning solution that enters the solution tank 105 via an inlet. In an embodiment, the pre-filter 110 may be inside the solution tank 105 in proximity to an inlet of the solution tank. The pre-filter 110 may be connected to the solution tank 105 and may surround or otherwise cover at least a portion of the inlet. In an embodiment, a pre-filter 110 may be formed from passivated stainless steel mesh. The mesh may be formed from plain weave stainless wire. In an embodiment, the wire may be approximately 0.022 inches thick. In an embodiment, a pre-filter 110 may be cylindrically shaped with an opening on a top portion to capture debris. In an embodiment, the diameter of the opening may be approximately 3.875 inches. In an embodiment, one or more openings between wires of the filter may have a diameter of approximately 0.060 inches.

In an embodiment, the cleaning device may include a bypass line 160. The bypass line 160 may have an intake through which cleaning solution may be delivered to the bypass line. In an embodiment, a bypass line 160 may have a discharge through which cleaning solution may exit the bypass line. The bypass line 160 may fluidly connect an inlet of the solution tank 105 and the downstream end of the flow meter 135. In an embodiment, a tee fitting 165 may be located downstream from the flow meter 135 and upstream from the first valve 155. In an embodiment, a bypass line 160 may connect the tee fitting 165 and the solution tank 105 to divert cleaning fluid toward the solution tank and away from the cleaning head 140. In an embodiment, a bypass line 160 may connect the tee fitting 165 and the solution tank 105 via a second valve 170. The second valve 170 may be associated with the cleaning head 140. In an embodiment, the second valve 170 may be located upstream from the cleaning head 140, but downstream from the flow meter 135. In an embodiment, a second valve 170 may be a solenoid valve or other type of valve.

In an embodiment, the cleaning device may operate in a priming mode. In priming mode, the first valve 155 may be closed, and the second valve 170 may be open. In an embodiment, a cleaning device 100 may be configured to automatically operate in priming mode when the cleaning device is powered on. Cleaning solution may circulate in a loop between the pump 130 and the solution tank 105 until the flow rate of the cleaning solution reaches a desired flow rate for a period of time. In an embodiment, when the flow rate reaches a desired flow rate for a period of time, the second valve 170 may be closed, and the first valve 155 may be opened so the cleaning solution is delivered to the cleaning head 140.

In an embodiment, a three-way valve may be used in place of a first valve 155 and a second valve 170. A three-way valve may have one inlet and two outlets. The inlet of the three-way valve may be fluidly connected to the flow meter 135 such that fluid may flow from the flow meter to an inlet of the three-way valve. A first outlet of the three-way valve may be fluidly connected to an inlet of the bypass line 160. A second outlet of the three-way valve may be fluidly connected to the cleaning head 140. The first outlet and/or the second outlet of the three-way valve may be configured to be opened and/or closed.

Figure 2A:
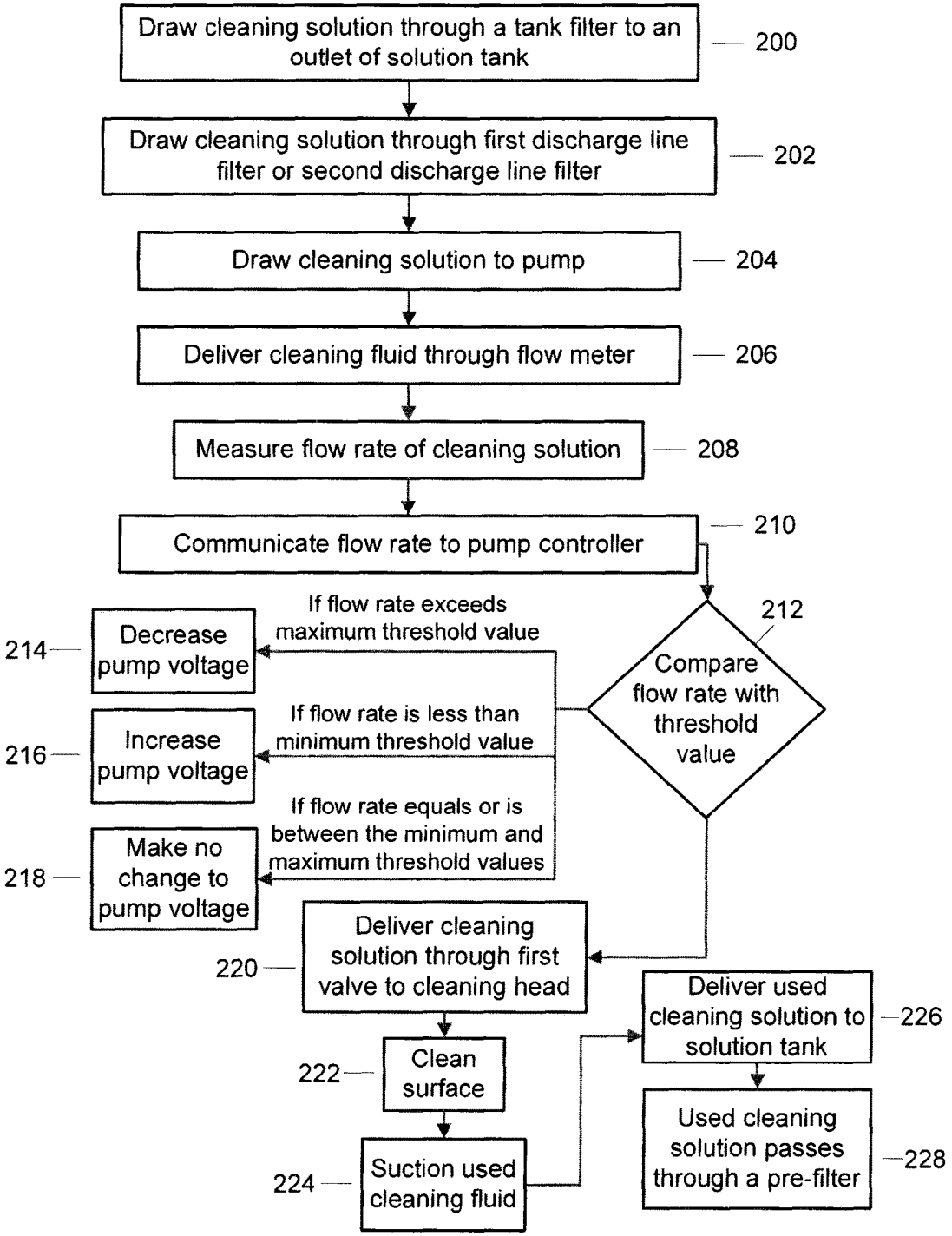
FIG. 2A illustrates an exemplary method of operating a cleaning device according to an embodiment.

FIG. 2A illustrates an exemplary method of operating the cleaning device illustrated in FIG. 1 according to an embodiment. As illustrated by FIG. 2A, the pump may draw 200 cleaning solution through a tank filter to an outlet of a solution tank. The cleaning solution may be drawn 202 from the outlet through the first discharge line filter or the second discharge line filter. In an embodiment, the cleaning solution may be drawn 204 to the pump. The pump may deliver 206 the cleaning fluid through a flow meter. The flow meter may measure 208 the flow rate of the cleaning solution. The flow meter may communicate 210 the flow rate to a pump controller. The pump controller may compare 212 the received flow rate with one or more threshold values. For example, the pump controller may compare 212 the received flow rate with a minimum threshold value and a maximum threshold value. If the received flow rate exceeds the maximum threshold value, the pump controller may decrease 214 the pump voltage. If the received flow rate is less than the minimum threshold value, the pump controller may increase 216 the pump voltage. If the received flow rate equals the minimum threshold value and/or the maximum threshold value, or is between the minimum threshold value and the maximum threshold value, the pump controller may not change 218 the pump voltage.

In an embodiment, the cleaning solution may be delivered 220 from the flow meter through the first valve to the cleaning head. The cleaning head may use the cleaning solution to clean 222 a surface. The used cleaning solution may be suctioned 224 into the cleaning device via a squeegee. The used cleaning solution may be delivered 226 to the solution tank. The cleaning solution may enter the solution tank through an inlet, and may pass 228 through a pre-filter.

Figure 2B:
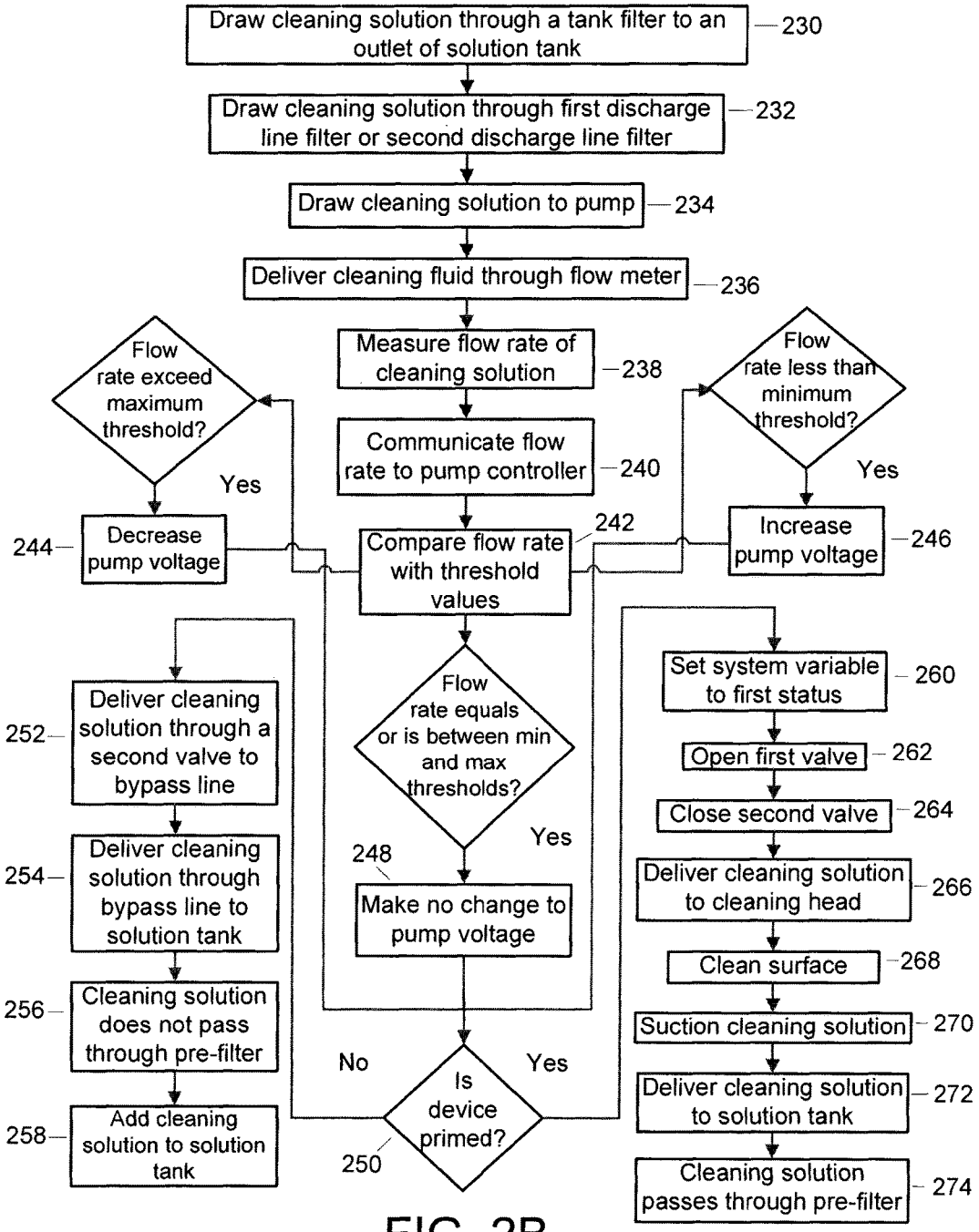
FIG. 2B illustrates an exemplary method of operating a cleaning device in priming mode according to an embodiment.

FIG. 2B illustrates an exemplary method of operating the cleaning device illustrated in FIG. 1 in priming mode according to an embodiment. As illustrated by FIG. 2B, the pump may draw 230 cleaning solution through a tank filter to an outlet of a solution tank. The cleaning solution may be drawn 232 from the outlet through the first discharge line filter or the second discharge line filter. The cleaning solution may be drawn 234 through the first discharge line filter or the second discharge line filter to the pump. The pump may deliver 236 the cleaning fluid through a flow meter. The flow meter may measure 238 the flow rate of the cleaning solution. The flow meter may communicate 240 the flow rate to a pump controller. The pump controller may compare 242 the received flow rate with one or more threshold values. For example, the pump controller may compare 242 the received flow rate with a minimum threshold value and a maximum threshold value. If the received flow rate exceeds the maximum threshold value, the pump controller may decrease 244 the pump voltage. If the received flow rate is less than the minimum threshold value, the pump controller may increase 246 the pump voltage. If the received flow rate equals the minimum threshold value and/or the maximum threshold value, or is between the minimum threshold value and the maximum threshold value, the pump controller may not change 248 the pump voltage.

In an embodiment, a cleaning device may operate in priming mode. While operating in priming mode, cleaning solution may be recycled through the cleaning device for a period of time. At the completion of the period of time, the cleaning device is primed. Operating in priming mode may help the cleaning device generate a consistent flow rate before it begins cleaning a surface.

In an embodiment, priming mode may be initiated based on one or more of a system status variable, a state of the lower float switch (190 in FIG. 1) and operator input. In an embodiment, a system status variable may be set to a first status, such as true, 'one', or another status when the cleaning device may be considered primed. In an embodiment, a cleaning device status may be set to "primed" when the flow rate of the cleaning solution equals or exceeds a threshold value for a period of time. In an embodiment, a cleaning device may be primed when the lower float switch is fully engaged. In an embodiment, a cleaning device may be primed when the lower float switch is fully engaged for a period of time.

Conversely, a system status variable may be set to a second status, such as false, 'zero', or another status when the cleaning device is not primed. For example, a system status variable may be set to zero when the cleaning device is powered off. In an embodiment, a system status variable may be set to a second status when the lower float switch is not engaged and/or when the cleaning device is powered on. In an embodiment, a priming sequence may be initiated when the system status variable is set to false, and the lower float switch transitions from not floating to floating. In an embodiment, a priming sequence may be initiated when the system status variable is set to false and an operator presses a button, flips a switch or otherwise engages a trigger of the cleaning device to initiate the priming mode. In an embodiment, an operator may initiate priming mode if it has been previously interrupted or disabled.

In an embodiment, the cleaning device may determine 250 whether it is primed. If it is not, the cleaning device may operate in priming mode. In priming mode, the first valve (135 in FIG. 1) may be closed and the second valve (170 in FIG. 1) may be open. The pump may deliver 252 cleaning solution from the flow meter through a second valve to a bypass line. The cleaning solution may be delivered 254 through the bypass line to the solution tank. In an embodiment, the solution may not pass 256 through a filter before it is added 258 to the solution tank. In an embodiment, this process may continue until the cleaning device is primed.

In an embodiment, the cleaning device may be primed if the flow rate of the cleaning solution equals or exceeds a threshold value for a period of time. For example, the cleaning device may be primed if the flow rate has exceeded 0.50 gallons per minute for at least 15 seconds.

In an embodiment, if the cleaning device is primed, the system status variable may be set 260 to a first status and the pump controller may open 262 the first valve and close 264 the second valve. Cleaning solution may be delivered 266 from the flow meter to through the first valve to the cleaning head. The cleaning head may use the cleaning solution to clean 268 a surface. The used cleaning solution may be suctioned 270 into the cleaning device via a squeegee. The used cleaning solution may be delivered 272 to the solution tank. The cleaning solution may enter the solution tank through an inlet, and may pass 274 through a pre-filter.

Figure 3:
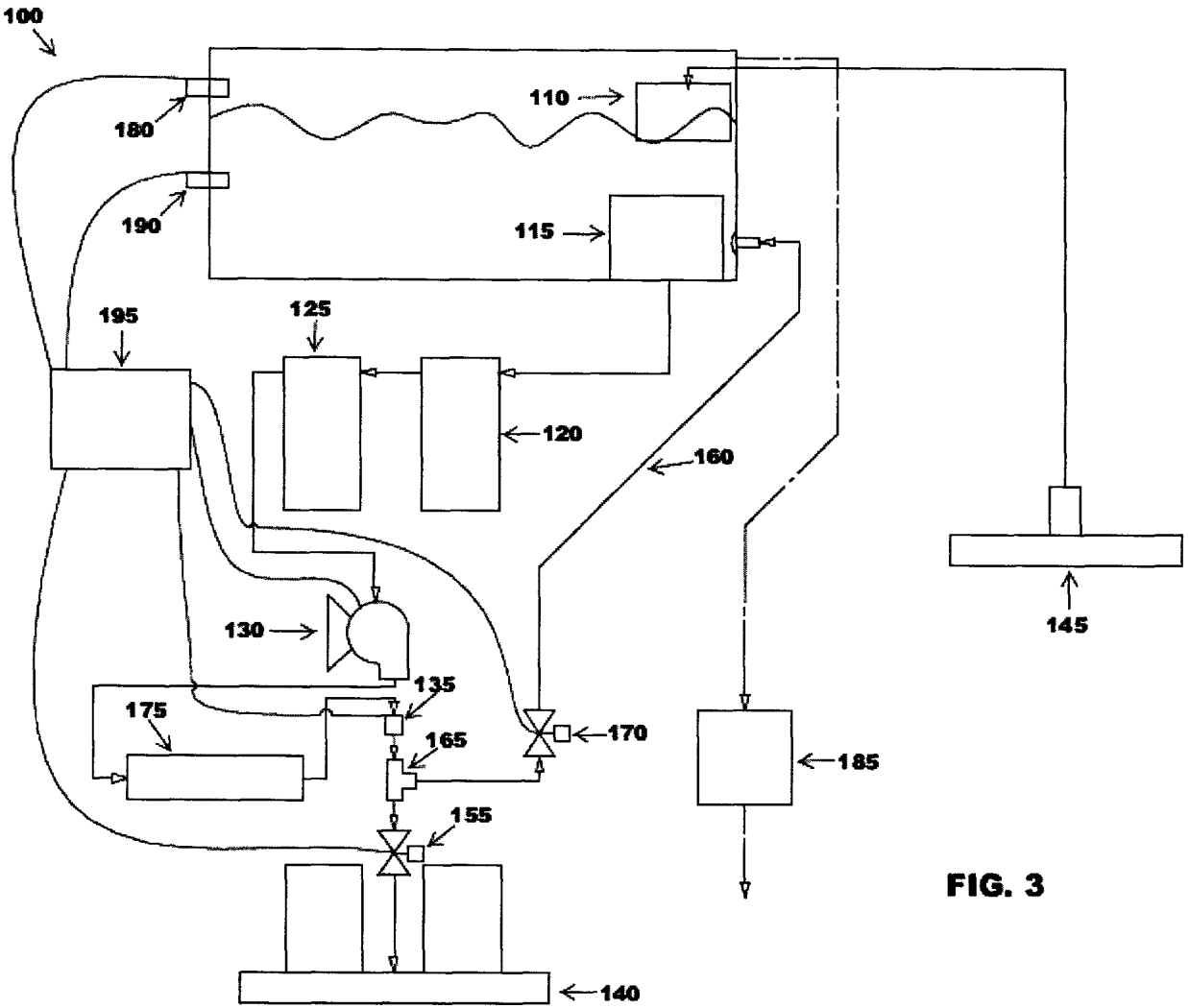
FIG. 3 illustrates an exemplary cleaning device according to an embodiment.

FIG. 3 illustrates an exemplary cleaning device according to an embodiment. As illustrated by FIG. 3, the first discharge line filter 120 and the second discharge line filter 125 may be in series. In an embodiment, the cleaning solution may be drawn from an outlet of the first discharge line filter 120 to an inlet of the second discharge line filter 125. This filtering process may be used on surfaces that should be thoroughly cleaned, such as hospital floors, schools and/or the like.

In an embodiment, an ultraviolet light source 175 may be located between the pump 130 and the flow meter 135. In an embodiment, an ultraviolet light source 175 may be any suitable ultraviolet light source. The ultraviolet light source 175 may be in fluid communication with the pump 130 and the flow meter 135. Cleaning solution may be delivered to the ultraviolet light source 175 from the pump 130. The ultraviolet light source 175 may further sanitize the cleaning solution. The cleaning solution may be delivered to the flow meter 135 from the ultraviolet light 175 source.

Figure 4A:
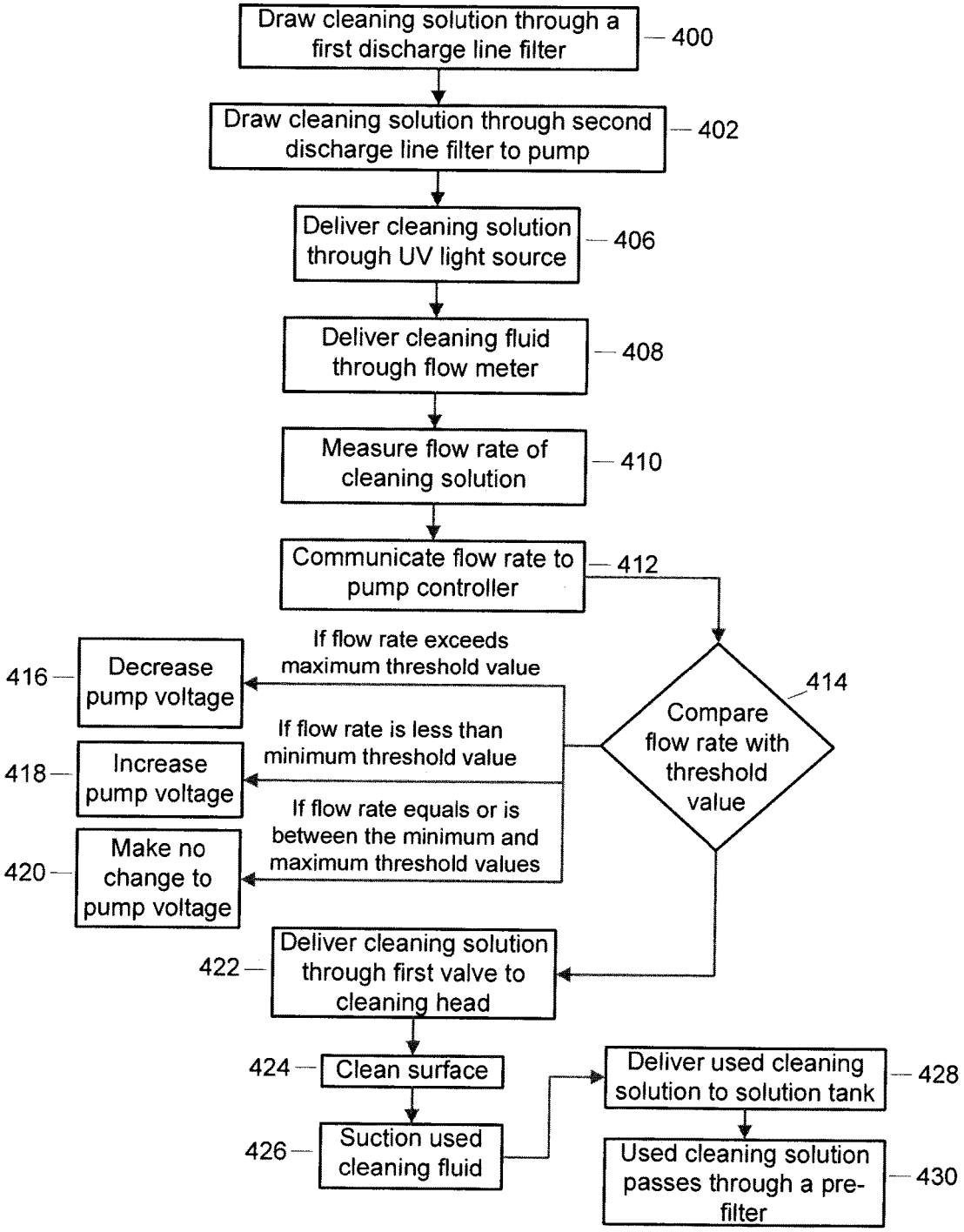
FIG. 4A illustrates an exemplary method of operating a cleaning device according to an embodiment.

FIG. 4A illustrates an exemplary method of operating the cleaning device illustrated in FIG. 3 according to an embodiment. As illustrated by FIG. 4A, the pump may draw cleaning solution through a tank filter to an outlet of a solution tank. The cleaning solution may be drawn 400 from the outlet through the first discharge line filter. The cleaning solution may be drawn 404 through the second discharge line filter to the pump. The pump may deliver 406 the cleaning fluid through an ultraviolet light source. The cleaning fluid may be delivered 408 from the ultraviolet light source through a flow meter. The flow meter may measure 410 the flow rate of the cleaning solution. The flow meter may communicate 412 the flow rate to a pump controller. The pump controller may compare 414 the received flow rate with one or more threshold values. For example, the pump controller may compare 414 the received flow rate with a minimum threshold value and a maximum threshold value. If the received flow rate exceeds the maximum threshold value, the pump controller may decrease 416 the pump voltage. If the received flow rate is less than the minimum threshold value, the pump controller may increase 418 the pump voltage. If the received flow rate equals the minimum threshold value and/or the maximum threshold value, or is between the minimum threshold value and the maximum threshold value, the pump controller may not change 420 the pump voltage. In an embodiment, the cleaning solution may be delivered 422 from the flow meter through the first valve to the cleaning head. The cleaning head may use the cleaning solution to clean 424 a surface. The used cleaning solution may be suctioned 426 into the cleaning device via a squeegee. The used cleaning solution may be delivered 428 to the solution tank. The cleaning solution may enter the solution tank through an inlet, and may pass 430 through a pre-filter.

Figure 4B:
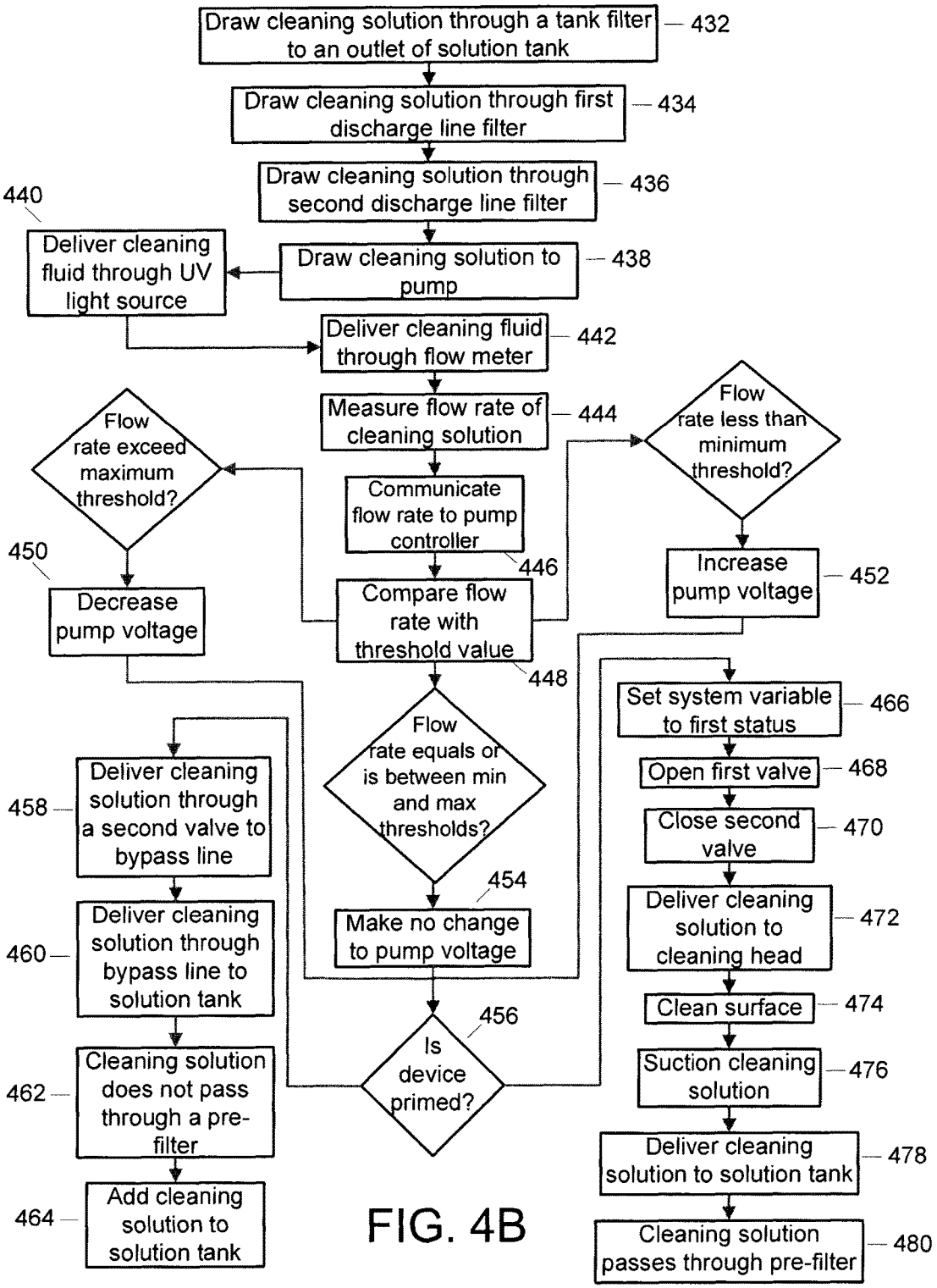
FIG. 4B illustrates an exemplary method of operating a cleaning device in priming mode according to an embodiment.

FIG. 4B illustrates an exemplary method of operating the cleaning device illustrated in FIG. 3 in priming mode according to an embodiment. As illustrated by FIG. 4A, a pump may draw 432 cleaning solution through a tank filter to an outlet of a solution tank. The cleaning solution may be drawn 434 from the outlet through the first discharge line filter. The cleaning solution may be drawn 436 through the second discharge line filter to the pump. The pump may deliver 440 the cleaning fluid through an ultraviolet light source. The cleaning fluid may be delivered 442 from the ultraviolet light source through a flow meter. The flow meter may measure 444 the flow rate of the cleaning solution. The flow meter may communicate 446 the flow rate to a pump controller. The pump controller may compare 448 the received flow rate to one or more threshold values. For example, the pump controller may compare 448 the received flow rate to a minimum threshold value and a maximum threshold value. If the received flow rate exceeds the maximum threshold value, the pump controller may decrease 450 the pump voltage. If the received flow rate is less than the minimum threshold value, the pump controller may increase 452 the pump voltage. If the received flow rate equals the minimum threshold value and/or the maximum threshold value, or is between the minimum threshold value and the maximum threshold value, the pump controller may not change 454 the pump voltage.

In an embodiment, the cleaning device may determine 456 whether it is primed. If it is not, the cleaning device may operate in priming mode. In priming mode, the first valve may be closed and the second valve may be open. The pump may deliver 458 cleaning solution from the flow meter through a second valve to a bypass line. The cleaning solution may be delivered 460 through the bypass line to the solution tank. In an embodiment, the solution may not pass 462 through a filter before it is added 464 to the solution tank. In an embodiment, this process may continue until the cleaning device is primed.

In an embodiment, the cleaning device may be primed if the flow rate of the cleaning solution equals or exceeds a threshold value for a period of time. For example, the cleaning device may be primed if the flow rate has exceeded 0.50 gallons per minute for at least 15 seconds.

In an embodiment, if the cleaning device is primed, the system status variable may be set 466 to a first status and the pump controller may open 468 the first valve and close 470 the second valve. Cleaning solution may be delivered 472 from the flow meter to through the first valve to the cleaning head. The cleaning head may use the cleaning solution to clean 474 a surface. The used cleaning solution may be suctioned 476 into the cleaning device via a squeegee. The used cleaning solution may be delivered 478 to the solution tank. The cleaning solution may enter the solution tank through an inlet, and may pass 480 through a pre-filter.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A method of cleaning a surface, the method comprising, by a cleaning device:

drawing cleaning solution through a tank filter that is in fluid communication with an outlet of a solution tank of a cleaning device;

drawing the cleaning solution through one or more discharge line filters to a pump intake of the cleaning device;

delivering the cleaning solution from a pump discharge of the cleaning device to a flow meter;

initiating a priming mode by:

opening a first valve associated with a bypass line that is in fluid communication with the pump discharge and an inlet of the solution tank, closing a second valve associated with a cleaning head of the cleaning device, and delivering the cleaning solution from a discharge of the flow meter to the inlet of the solution tank through the bypass line;

measuring a flow rate of the cleaning solution using the flow meter; determining that the cleaning device is primed if the measured flow rate equals or exceeds a threshold value for a period of time, and determining that the cleaning device is not primed if the measured flow rate does not equal or exceed the threshold value for the period of time;

when the cleaning device is determined to not be primed, continuing the priming mode by delivering the cleaning solution to the bypass line instead of the cleaning head; and when the cleaning device is primed, initiating cleaning by:

closing the first valve associated with the bypass line, opening the second valve associated with the cleaning head, and delivering the cleaning solution to the cleaning head.

2. The method of claim 1, further comprising, before initiating the priming mode, determining that the cleaning device is not primed by:

determining that a system status variable is false; and determining one or more of the following:

that a lower float switch in the solution tank transitioned from not floating to floating; and that operator input indicates that the cleaning device is not primed.

3. The method of claim 1, wherein drawing the cleaning solution through one or more discharge line filters to the pump intake comprises:

drawing the cleaning fluid through a first discharge line filter or through a second discharge line filter, wherein the first discharge line filter and the second discharge line filter are in fluid communication with the outlet of the solution tank, and wherein the first discharge line filter and the second discharge line filter have equal filter sizes.

4. The method of claim 1, wherein drawing the cleaning solution through one or more discharge line filters to the pump intake comprises:

drawing the cleaning fluid through a first discharge line filter that is in fluid communication with the outlet of the solution tank; and drawing the cleaning fluid through a second discharge line filter that is in communication with the first discharge line filter, wherein a size of the first discharge line filter is larger than a size of the second discharge line filter.

5. The method of claim 1, further comprising, during the cleaning:

measuring, by the flow meter, a flow rate associated with the cleaning solution; and in response to determining that the flow rate exceeds a maximum threshold value, decreasing, by a pump controller, a pump voltage associated with the pump.

6. The method of claim 1, further comprising, during the cleaning:

measuring, by the flow meter, a flow rate associated with the cleaning solution; and in response to determining that the flow rate is less than a minimum threshold value, increasing, by a pump controller, a pump voltage associated with the pump.

7. The method of claim 1, further comprising, during the cleaning:

measuring, by the flow meter, a flow rate associated with the cleaning solution; and in response to determining that the flow rate is less than a minimum threshold value, opening the first valve with the bypass line and delivering the cleaning solution through the bypass line to the solution tank instead of to the cleaning head.

8. The method of claim 1, further comprising sanitizing the cleaning fluid by drawing the cleaning fluid through an ultraviolet light source.

9. The method of claim 1, further comprising:

dispensing the cleaning solution through the cleaning head;

cleaning, by the cleaning head, a surface using the cleaning solution to produce used cleaning solution; and suctioning the used cleaning solution by an absorbent instrument of the cleaning device to the solution tank.

10. A method of cleaning a surface, the method comprising, by a cleaning device:

initiating a priming mode of a cleaning device having a solution tank and a pump by:

opening a first valve associated with a bypass line that is in fluid communication with a pump discharge of the pump and an inlet of the solution tank, closing a second valve associated with a cleaning head of the cleaning device, and delivering the cleaning solution to the inlet of the solution tank through the bypass line;

determining whether the cleaning device is primed by:

measuring, by a flow meter, a flow rate associated with the cleaning solution, communicating, by the flow meter to a pump controller, the flow rate, determining whether the flow rate has equaled or exceeded a threshold value for a period of time, and determining that the cleaning device is primed if the flow rate has equaled or exceeded a threshold value for a period of time, and determining that the cleaning device is not primed if the flow rate does not equal or exceed the threshold value for the period of time;

continuing the priming mode by continuing to deliver the cleaning solution to the solution tank through the bypass line until the cleaning device is determined to be printed; and in response to determining that the cleaning device is primed, initiating cleaning by:

closing the first value associated with the bypass line, opening the second valve associated with the cleaning head, and delivering the cleaning solution to the cleaning head.

11. The method of claim 10, further comprising:

drawing the cleaning solution through a tank filter that is in fluid communication with an outlet of the solution tank of the cleaning device;

drawing the cleaning solution through one or more discharge line filters to a pump intake of the cleaning device; and delivering the cleaning solution from a pump discharge of the cleaning device to the flow meter.

12. The method of claim 11, wherein drawing the cleaning solution through one or more discharge line filters to the pump intake comprises:

drawing the cleaning fluid through a first discharge line filter or through a second discharge line filter, wherein the first discharge line filter and the second discharge line filter are in fluid communication with the outlet of the solution tank, and wherein the first discharge line filter and the second discharge line filter have equal filter sizes.

13. The method of claim 11, wherein drawing the cleaning solution through one or more discharge line filters to the pump intake comprises:

drawing the cleaning fluid through a first discharge line filter that is in fluid communication with the outlet of the solution tank; and drawing the cleaning fluid through a second discharge line filter that is in communication with the first discharge line filter, wherein a size of the first discharge line filter is larger than a size of the second discharge line filter.

14. The method of claim 10, further comprising, during the cleaning:

measuring, by the flow meter, a flow rate associated with the cleaning solution; and in response to determining that the flow rate exceeds a maximum threshold value, decreasing, by a pump controller, a pump voltage associated with the pump.

15. The method of claim 10, further comprising, during the cleaning:

measuring, by the flow meter, a flow rate associated with the cleaning solution; and in response to determining that the flow rate is less than a minimum threshold value, increasing, by a pump controller, a pump voltage associated with the pump.

16. The method of claim 10, further comprising, during the cleaning:

measuring, by the flow meter, a flow rate associated with the cleaning solution; and in response to determining that the flow rate is less than a minimum threshold value, opening the first valve with the bypass line and delivering the cleaning solution through the bypass line to the solution tank instead of to the cleaning head.

17. The method of claim 10, further comprising sanitizing the cleaning fluid by drawing the cleaning fluid through an ultraviolet light source.

18. The method of claim 10, further comprising:

dispensing the cleaning solution through the cleaning head;

cleaning, by the cleaning head, a surface using the cleaning solution to produce used cleaning solution; and suctioning the used cleaning solution by an absorbent instrument of the cleaning device to the solution tank.

* * * * *